US006015220A

United States Patent [19]

Blusseau

[11] Patent Number: 6,015,220

[45] Date of Patent: Jan. 18, 2000

[54] ELLIPTICAL HEADLAMP WITH AN ATTENUATED CUT-OFF

[75] Inventor: Eric Blusseau, Malmaison, France

[73] Assignee: Valeo Vision, Bobigny, France

[21] Appl. No.: 09/170,591

[22] Filed: Oct. 13, 1998

[30] Foreign Application Priority Data

Oct. 14, 1997 [FR] France ..... 97 12816

[51] Int. Cl.[7] ..... F21V 7/00

[52] U.S. Cl. ..... 362/303; 362/538; 362/539; 362/257

[58] Field of Search ..... 362/257, 296, 362/297, 298, 302, 303, 305, 459, 538, 539

[56] References Cited

U.S. PATENT DOCUMENTS 4,800,467 1/1989 Lindae et al. ..... 362/539
4,862,329 8/1989 Nino .
5,307,247 4/1994 Cejnek .

FOREIGN PATENT DOCUMENTS 43 15 401 11/1994 Germany .
94/17326 8/1994 WIPO .

OTHER PUBLICATIONS

French Search Report dated Jun. 4, 1998.

*Primary Examiner*—Cassandra Spyrou
*Assistant Examiner*—Craig Curtis
*Attorney, Agent, or Firm*—Morgan & Finnegan, L.L.P.

[57] ABSTRACT

The invention relates to a headlamp for an automobile vehicle comprising an elliptical reflector, a light source positioned in a region of the first focus of the reflector, a lens, the focus of which is in a region of the second focus of the reflector, and a mask interposed between the reflector and the lens to effect a cut-off of the light beam emitted. A mirror is located in front of the mask and adapted to return direct light rays emitted by the light source onto the front face of the mask which thereby diffuses them towards the lens.

20 Claims, 2 Drawing Sheets

ELLIPTICAL HEADLAMP WITH AN ATTENUATED CUT-OFF

FIELD OF THE INVENTION

The present invention relates generally to headlamps for motor vehicles.

More particularly, the invention relates to a headlamp comprising a reflector of the elliptical type, a light source positioned in a region of the first focus of the reflector, a lens, the focus of which is in a region of the second focus of the reflector, and a mask interposed between the reflector and the lens to effect a cut-off of the light beam emitted.

BACKGROUND OF THE INVENTION

In known manner, the shape of the mask in such an arrangement is such that the cut-off beam emitted by the headlamp is normalized. However, the cut-off effected in the light beam is relatively sharp and above the cut-off the light beam has a very feeble intensity, and in fact is practically zero.

FIG. 2 of the accompanying drawings shows a diagrammatic example of the distribution of light intensity in a lighting beam emitted by a known elliptical headlamp (representation of the isolux curves of the beam). As can be seen, the zone A situated above the cut-off of the light beam contains very little light.

The fact that the light beam emitted by such a headlamp has a very low intensity above the cut-off may be particularly annoying for a driver attempting to see road signs located at a high level, for example on motorway gantry supports.

Furthermore, it is a requirement of the statutory regulations that the lighting beam emitted by an automobile vehicle headlamp must have a certain intensity above the cut-off of the beam.

In order to increase the intensity of the light beam above its cut-off, it is proposed, for example in document G 90 00 395, that the convex lens comprises in a lower part situated below the optical axis of the headlamp (coincident with the axis of the convex lens) refraction striations which elevate part of the light beam reflected by the reflector over a predetermined angle so as to graze the upper edge of the mask interposed between the latter and the lens.

However such an arrangement is not entirely satisfactory.

It is an object of the present invention to provide a new type of headlamp for an automobile vehicle which emits a lighting beam having a light intensity above the cut-off which is of an acceptable level and complies with regulations, making it possible to illuminate signs located at a high level for the driver.

DISCUSSION OF THE INVENTION

According to the invention, there is provided a headlamp comprising a mirror located in front of a mask and disposed to return direct light rays emitted by the light source onto the front face of the mask which thereby diffuses them towards the lens.

Thus, according to the invention, the light rays originating directly from the light source and returned by the returning mirror onto the front surface of the mask, which diffuses them towards the lens, enables a satisfactory increase in the light intensity of the lighting beam above its cut-off and attenuates the said cut-off. The light intensity of the beam above its cut-off is then sufficient to illuminate road signs located at a high level.

The return mirror may be a planar mirror or, alternatively, a mirror having a concavity directed towards the mask.

The following description, with reference to the attached drawings is given by way of non-limiting example.

DESCRIPTION OF THE PREFERRED EMBODIMENTS OF THE INVENTION

Figure 1:
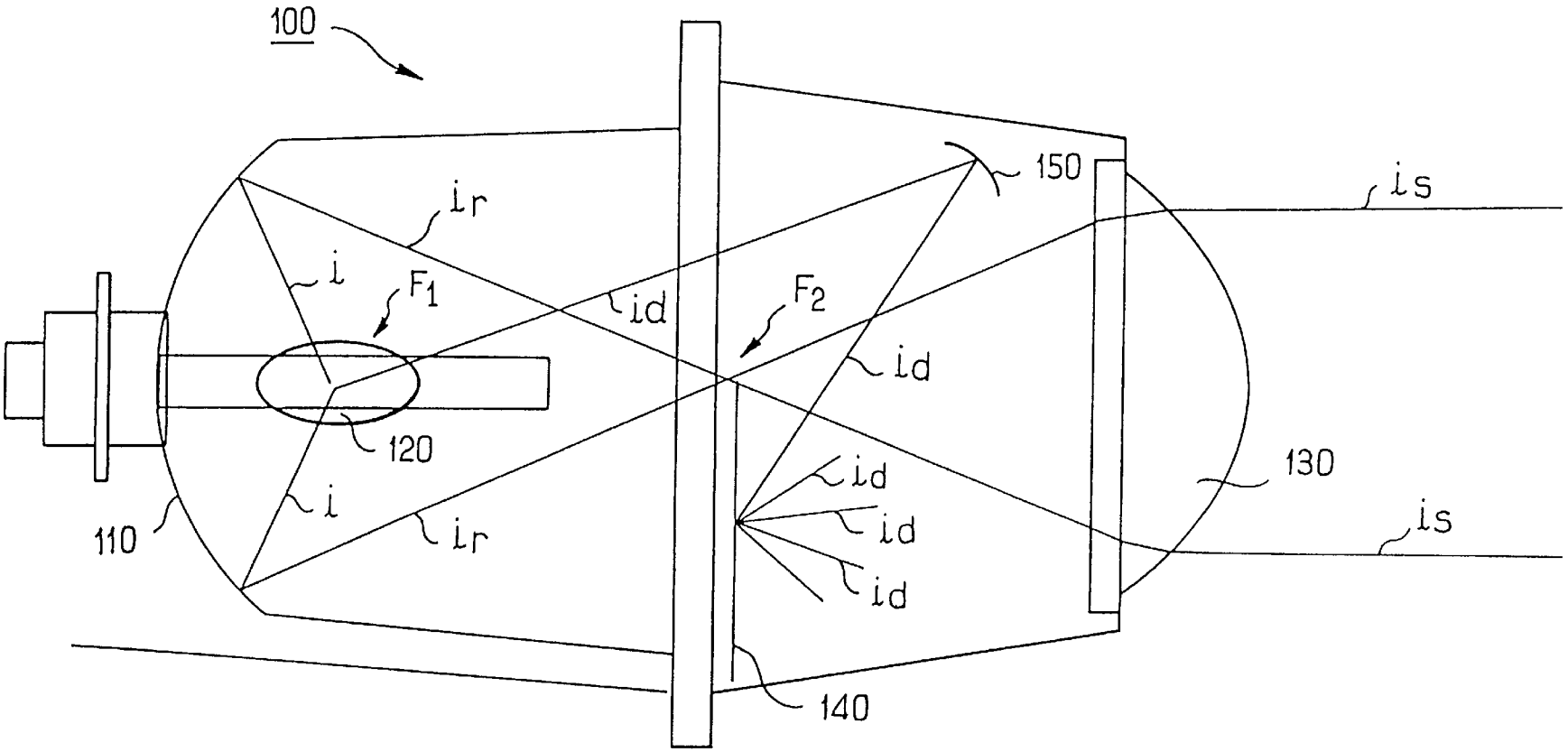
FIG. 1 is a diagrammatic view of a lateral section of a headlamp according to the invention.
Figure 2:
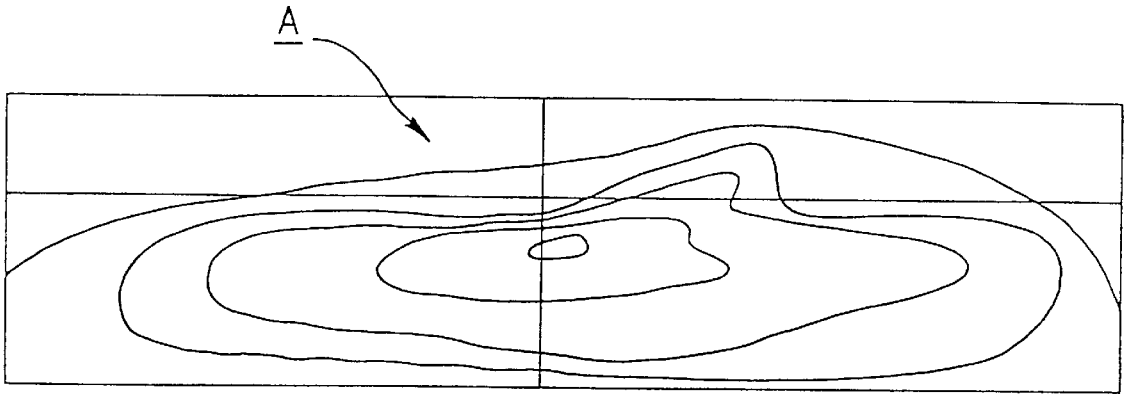
FIG. 2 is a diagrammatic representation of the isolux curves of a lighting beam emitted by a known elliptical headlamp.

FIG. 1 shows an elliptical headlamp 100 for an automobile vehicle. The headlamp 100 comprises a reflector 110 constituted by a portion of an ellipse and a single light source 120 located in a region of the first focus $F_1$ of the said reflector 110. In the headlamp 100, located a long distance away from the reflector 110, there is a convex lens 130 the focus of which is situated in a region of the second focus $F_2$ of the reflector 110.

Thus the rays i coming from the light source 120 towards the reflector 110 are reflected, and the reflected rays ir converging in the region of the second focus $F_2$ of the reflector 110 pass through the lens 130 and emerge from the headlamp in a direction substantially parallel to the axis X of the convex lens 130.

A mask 140 is interposed between the reflector 110 and the convex lens 130. It is positioned in a region of the second focus $F_2$ of the reflector and thus in the region of the focus of the lens. It has a shape designed so that the light beam in the cut-off region emerging from the headlamp complies with the regulations.

According to the invention, the headlamp 100 also comprises, in front of the mask 140 and in an upper region of the headlamp between the mask 140 and the convex lens 130, a return mirror 150 located such that it returns a portion of the direct light rays id emitted by the light source 120 towards the front surface of the mask 140. The rays id sent back by the return mirror 150 are then diffused by the front surface of the mask 140 towards the convex lens 130.

For this purpose the mask 140 will preferably be made of a material which absorbs light only to a slight extent, its front surface, facing towards the lens, may be covered by a coating having a light color (galvanised sheet metal for example).

Thus, the rays id diffused by the mask pass through the lens and are projected outwards, supplying light to a region located above the cut-off produced in the lighting beam emitted by the headlamp by the mask. The intensity of the light beam above its cut-off is then increased and the cut-off is attenuated.

Figure 3:
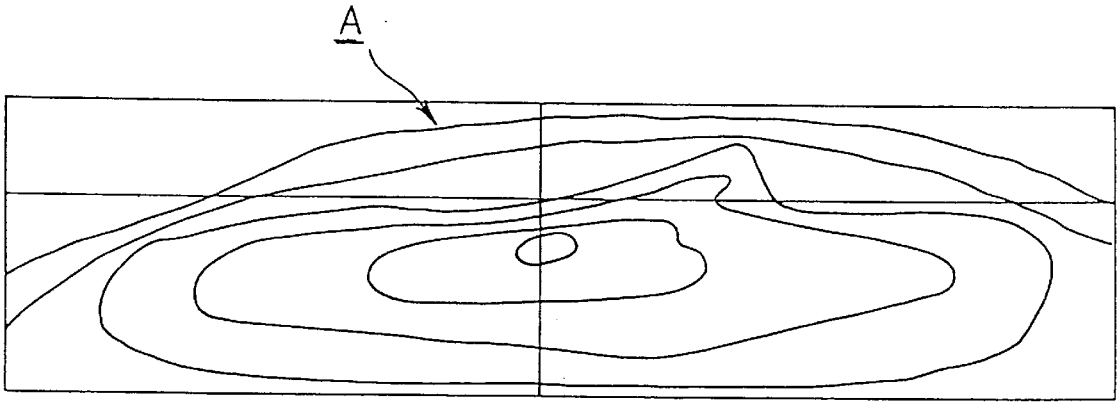
FIG. 3 is a diagrammatic representation of the isolux curves of a lighting beam emitted by a headlamp according to the invention.

FIG. 3 shows diagrammatically the isolux curves of a lighting beam emitted by a headlamp 100 such as that shown in FIG. 1. As can be seen in this figure, the zone A situated above the cut-off of the lighting beam has a certain light intensity. This light intensity conforms to the standards in force and it is sufficient to illuminate, if this is necessary, high level road signs.

According to the embodiment shown in FIG. 1, the return mirror 100 is a concave mirror having a concavity directed towards the mask 140. In other embodiments the mirror 150 may be a planar mirror.

The present invention is not limited to the embodiments described and shown.

I claim:

1. A headlamp for a vehicle comprising:

a reflector having a first focus and a second focus;

a light source positioned in a region of the first focus;

a lens having a focus in a region of the second focus;

a mask interposed between the reflector and the lens to effect a cut-off of an emitted light beam; and a mirror disposed in front of the mask and positioned to return direct light rays emitted by the light source onto a face of the mask to diffuse the direct light rays towards the lens.

2. The headlamp according to claim 1, wherein the mirror comprises a planar mirror.

3. The headlamp according to claim 1, wherein the mirror is concave towards the mask.

4. The headlamp according to claim 1, wherein the mirror is located in an upper region of the headlamp between the mask and the lens.

5. The headlamp according to claim 1, wherein the face comprises a coating having a light color.

6. The headlamp according to claim 1, wherein the mask is arranged in a region of the second focus.

7. A vehicle including the headlamp of claim 1.

8. A headlamp for a vehicle comprising:

means for emitting light rays;

means for reflecting the light rays towards a lens to produce a light beam;

means for effecting a cut-off of the light beam; and means for diffusing a portion of direct light rays from the means for emitting towards the lens.

9. The headlamp according to claim 8, further comprising means for guiding the portion of direct light rays from the means for emitting to the means for diffusing.

10. The headlamp according to claim 8, wherein the means for effecting includes the means for diffusing.

11. A headlamp for an automobile comprising:

a light source to emit light rays;

a lens;

a reflector to reflect the light rays towards the lens to produce a light beam;

a mask interposed between the reflector and the lens to effect a cut-off of the light beam; and diffusing means to diffuse a portion of direct light rays from the light source towards the lens.

12. The headlamp according to claim 11, wherein the diffusing means comprises a surface portion of the mask.

13. The headlamp according to claim 12, further comprising a mirror adapted to guide the portion of direct light rays onto the surface portion of the mask to diffuse the portion of direct light rays towards the lens.

14. The headlamp according to claim 12, wherein the surface portion of the mask comprises a coating having a light color.

15. The headlamp according to claim 11 wherein the mask is arranged in a region of the second focus.

16. A vehicle including a headlamp of claim 11.

17. A method comprising:

emitting light rays with a light source;

reflecting the light rays towards a lens to produce a light beam with a reflector;

effecting a cut-off of the light beam with a mask; and diffusing a portion of direct light rays from the light source towards the lens with the mask.

18. The method according to claim 17, further comprising guiding the portion of direct light rays towards the mask through the use of a mirror.

19. The method according to claim 11, wherein the diffusing supplies light to a region located above the cut-off of the light beam.

20. The method according to claim 11, wherein the diffusing increases an intensity of the light beam above the cut-off.

* * * * *